United States Patent [19]

Lare et al.

[11] Patent Number: 4,578,288

[45] Date of Patent: Mar. 25, 1986

[54] WEB COATING METHOD AND APPARATUS

[75] Inventors: Donald W. Lare, Greenville; Thanh Van Nguyen, Painesville, both of Ohio

[73] Assignee: Avery International Corporation, Pasadena, Calif.

[21] Appl. No.: 710,330

[22] Filed: Mar. 11, 1985

[51] Int. Cl.[4] ..... B05D 1/18; B05D 3/12; B05C 3/00; B05C 11/02

[52] U.S. Cl. ..... 427/365; 118/33; 118/106; 118/117; 118/119; 118/414; 118/415; 427/172; 427/434.3

[58] Field of Search ..... 427/172, 176, 365, 434.3; 118/106, 117, 119, 407, 410, 414, 415, 33

[56] References Cited

U.S. PATENT DOCUMENTS 3,169,887 2/1965 York ..... 118/410 X
3,235,400 2/1966 Voelker ..... 427/10
3,924,561 12/1975 Ruthort et al. ..... 118/414 X
4,256,870 3/1981 Eckberg ..... 528/15
4,294,872 10/1981 Kullander ..... 427/358

FOREIGN PATENT DOCUMENTS 1350262 12/1963 France ..... 427/434.3

*Primary Examiner*—Evan K. Lawrence
*Attorney, Agent, or Firm*—Pearne, Gordon, Sessions, McCoy, Granger & Tilberry

[57] ABSTRACT

An array of at least three parallel rolls is provided. The rolls are constrained against each other to provide an elongated coating chamber through which passes a web entrained on at least one of the rolls. As it exits from the chamber, the coated web surface is wiped by another of the rolls, whose surface is entering the chamber at that point.

18 Claims, 12 Drawing Figures

WEB COATING METHOD AND APPARATUS

BACKGROUND OF THE INVENTION

This invention relates to web coating, and particularly to a method and apparatus for applying a coating composition to a passing web or webs under controlled conditions which include close containment of the coating composition up to the point of application and wiping of the coated surface of the web by a countermoving surface as the web leaves the point of application.

Various coating means of this general nature have previously been proposed, as in U.S. Pat. Nos. 3,235,400 and 4,294,872, but the present invention provides an alternative that is effective and overcomes disadvantages of prior proposals.

The invention has various possible applications, and presently appears particularly useful for coating webs of paper or plastic with highly reactive solventless coating compositions, such as the catalyzed silicone compositions referred to in U.S Pat. No. 4,256,870. As discussed in that patent, such compositions are characterized by a very short pot life in the absence of the use of a cure inhibitor which delays cure until the temperature of the coating is elevated in a curing oven or the like. Such coatings are so reactive that no means of coating has been fully satisfactory without use of the inhibitor and a subsequent heat cure. Apparatus is available to accurately meter and quickly mix separately stored components of such coating compositions, particularly the base polymer, catalyst, and cross linker, but with the short pot life of such mixture in the absence of an inhibitor, there has been no way to apply the coating composition without use of the inhibitor and subsequent heat cure. The present invention provides such a means, or at least minimizes reliance on heat cure. The result is a means for reducing or possibly eliminating heat treatment with attendant savings in the cost of providing and operating some or all of the curing oven capacity which is presently used.

Silicone coatings are generally used as release compositions to enable pressure-sensitive adhesive tapes or sheets or the like to be easily pulled from a protective liner or backing, or to be unwound in self-wound constructions, without degradation of the adhesive quality of the construction. Silicone coatings with no volatile components require light coating weights. The coatings must be reasonably uniform, and the combination of uniformity and light coating weight makes a demanding coating requirement. The present invention meets this requirement.

Silicone coatings, and particularly highly reactive coatings, are mentioned because they exemplify demanding coating applications, one example being moisture cure silicones such as room temperature vulcanization type compounds. However, the invention also provides effective coating means for coatings other than silicone compositions, e.g., urethanes that are moisture-curing. Also, the invention may be used for coatings that are neither reactive nor light in coating weight.

SUMMARY OF THE INVENTION

In accordance with the present invention, a coating method and apparatus for carrying out the method are provided, wherein at least three parallel rolls are utilized. The rolls are constrained against each other to provide an elongated coating chamber through which passes a web entrained on at least one of the rolls. As it exits from the chamber, the coated web surface is wiped by another of the rolls, whose surface is entering the chamber at that point.

GENERAL DESCRIPTION OF THE DRAWINGS

In the drawings, FIGS. 1 through 7 are schematic, diagrammatic representations of various examples of the invention. FIGS. 8 and 9 are schematic isometric drawings relating to end seal arrangements. FIGS. 10 through 12 are schematic illustrations of manifold arrangements and other provisions within the coating chamber.

DETAILED DESCRIPTION

Figure 1:
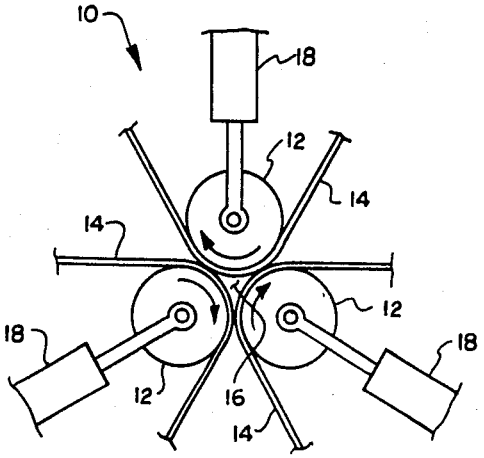

Shown in FIG. 1 is an array 10 or rolls 12 mounted with their axes in parallel. Three webs 14 are entrained partially around the rolls 12, each web 14 being associated with its own roll 12. The rolls 12 are rotated, in the directions indicated by the arrows, by suitable power drives (not shown) or by the pulling tensions on the corresponding webs 14.

The closely positioned rolls 12 and the webs 14 entrained thereon form an elongated chamber 16 surrounded by the array of rolls. Each of the rolls 12 is rotated in a direction to move its associated passing web 14 into the chamber 16. It will be seen that adjacent pairs of roll surfaces move counter to each other, so that as each web 14 enters the chamber 16, it wipes against an adjacent web 14 which is exiting the chamber 16. The chamber 16 is filled with a coating composition (not shown) supplied from a suitable source or sources (not shown) at one or both ends of the chamber 16. Each web is bathed in the coating composition as the web passes within the chamber 16. The rolls 12 are biased against each other by the hydraulic pressure cylinders 18. An alternative arrangement is to clamp the axis of one roll and use only two pressure cylinders, which still allows all three rolls to move relatively in order to compensate for variations in web caliper. Other biasing means for the roll ends may be employed. For example, in an initial reduction to practice of the invention, end bearings for one roll were clamped into position on the frame and the end bearings for the other two rolls were urged toward the first by elastic bands encircling the roll end bearings. The coating was not of a highly reactive type, and excess coating was allowed to simply run out the ends of the chamber defined by the rolls. However, good coating action was observed.

Figure 2:
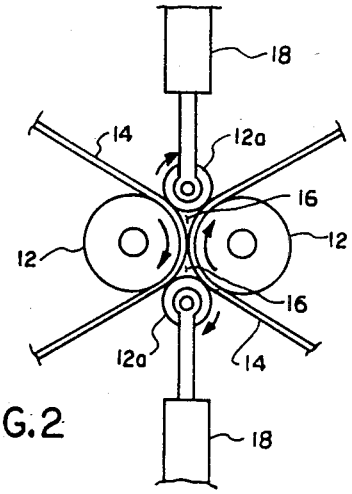

The arrangement shown in FIG. 2 is similar to that of FIG. 1, except that two small rolls 12*a* are provided, and the larger rolls 12 are fixed in adjusted positions to allow their corresponding webs 14 to barely pass each other in the chamber 16, which is thereby divided into two chambers. Only two webs 14 are coated in the installation shown in FIG. 2.

Figure 3:
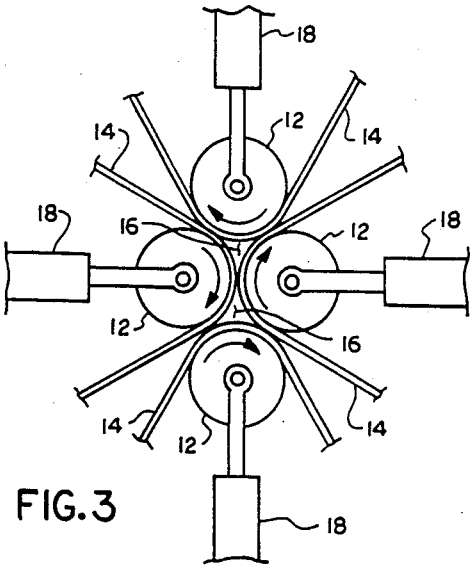

In the installation shown in FIG. 3, four rolls 12 are provided, each having its own actuator 18 and each having its own web 14 entrained on it. Again, the chamber 16 is divided by the two closely positioned rolls.

Figure 4:
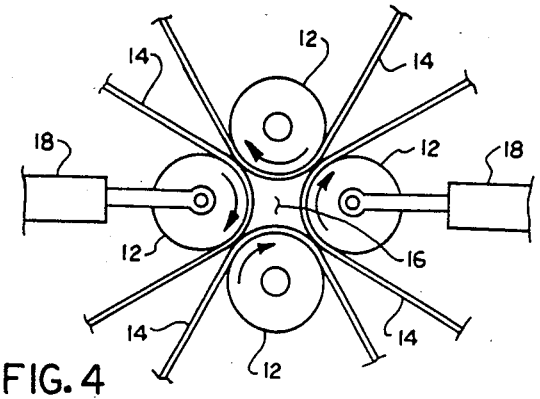

In FIG. 4, the arrangement is similar, except that the upper and lower rolls 12 are fixed and only the two lateral rolls 12 are provided with biasing means such as the cylinders 18. Also, the chamber 16 is not divided.

Figure 5:
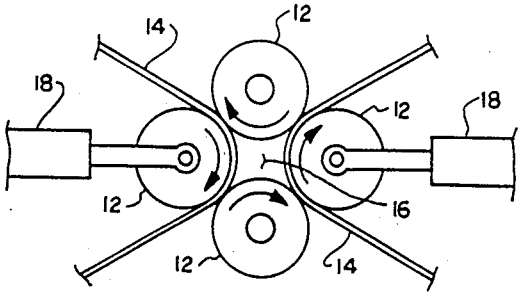

FIG. 5 is similar, except that only two webs 14 are entrained, and the coated surfaces of the exiting webs are not wiped by the countermoving entering webs but, rather, by the countermoving surfaces of the respective upper and lower rolls 12.

Figure 6:
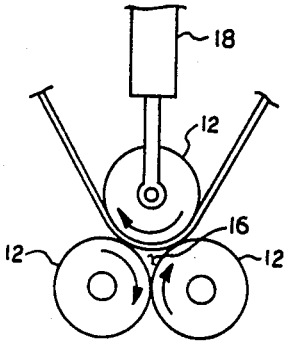

In FIG. 6, a web 14 is entrained over only one of the three rolls 12. The other two rolls are adjusted in position to just close the nip between them, and the third roll is biased by the cylinder 18.

Figure 7:
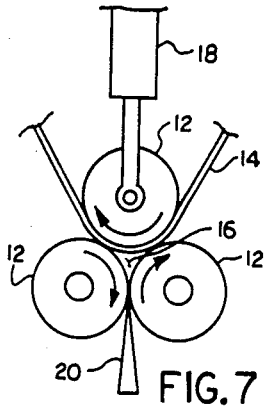

FIG. 7 is similar, except that a doctor blade or element 20 is provided to remove excess coating from the surface of the leftmost roll as it exits the chamber 16. Doctoring of excess coating and recirculation thereof, of course, is a common technique for coatings that are not extremely reactive. Obviously, the doctoring may be performed at other locations if indicated.

Figure 8:
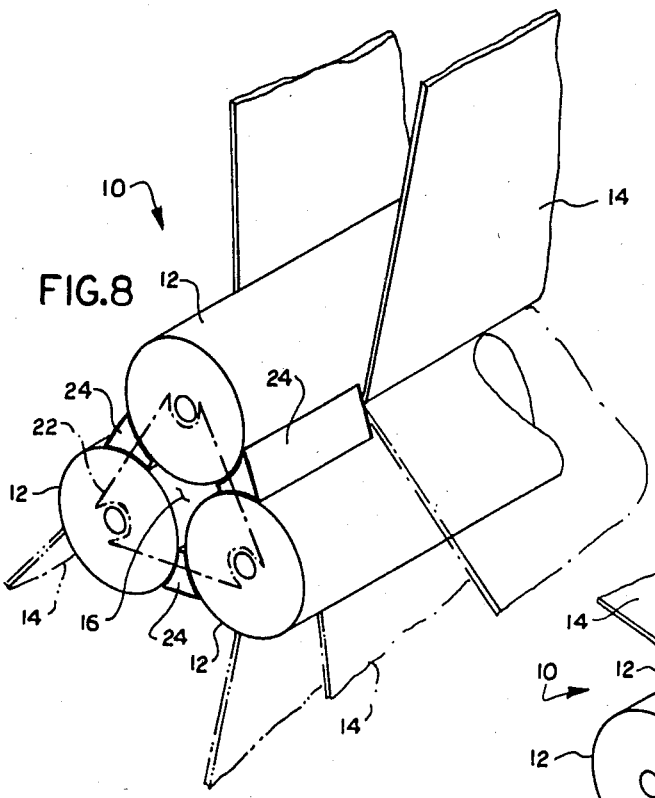
Figure 9:
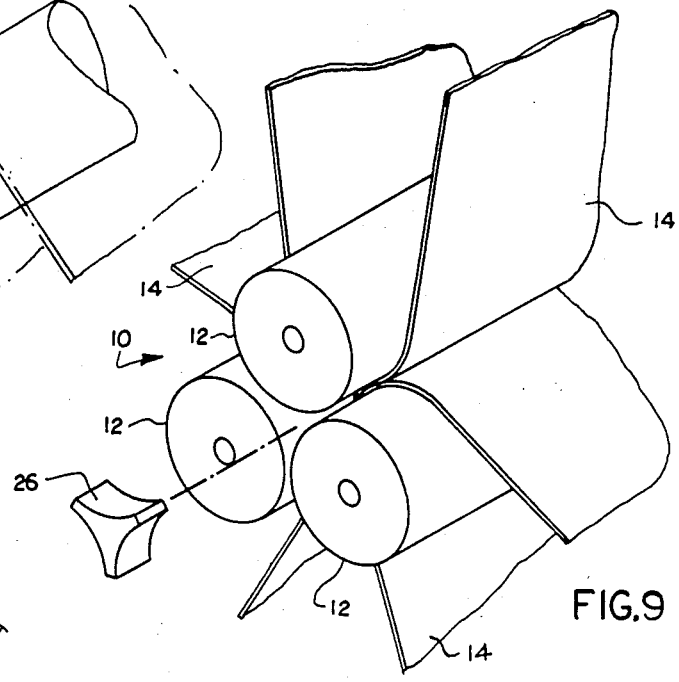

It is preferred to close the ends of the elongated chamber 16, and this is required in the case of highly reactive coatings. Suitable end dams may be provided, such as the end dam 22 shown schematically in FIG. 8. To compensate for the clearances caused by the absence of the web near the ends of the rolls, nip seals or blocks 24 may be provided, as shown, on the external sides of the rolls. These are preferably yieldable nylon or the like to allow for a slight relative movement between the rolls. Similarly, an internal end seal or plug 26 may be provided, as indicated in FIG. 9. Such an element might be provided at each end of the roll array in combination with and mounted on the inner side of a roll dam, such as element 22.

Figure 10:
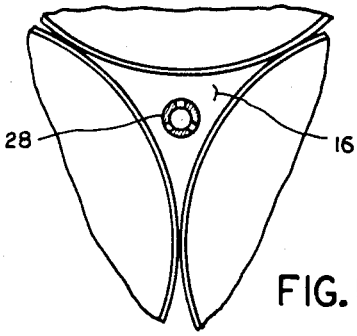

As shown in FIG. 10, a manifold or distributor pipe 28 may run along the elongated chamber 16 for distribution of the coating along the length of the chamber through small orifices as shown. The manifold 28 may pass through and be supported on a suitable end element such as the end dam 22 indicated in FIG. 8.

Figure 11:
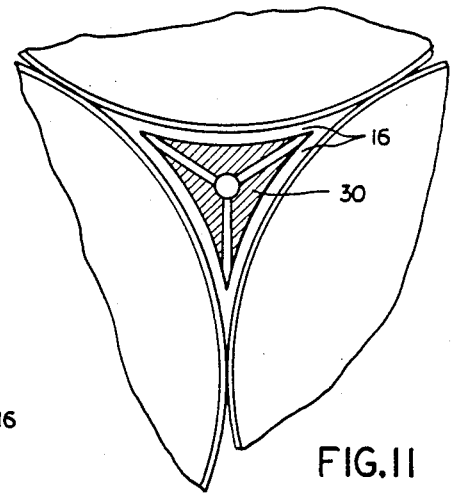

As shown in FIG. 11, filler means which may comprise a stationary filler element 30 may be provided to take up a substantial portion of the volume of the chamber 16. This increases the through-put velocity of the coating material, thereby reducing the resident time for, say, highly reactive coating compositions. As indicated in FIG. 11, the coating composition itself may be distributed through the element 30, for example, down a lengthwise central passage and then outwardly through radial passages which may, as shown, lead to the apices of the filler element 30.

Figure 12:
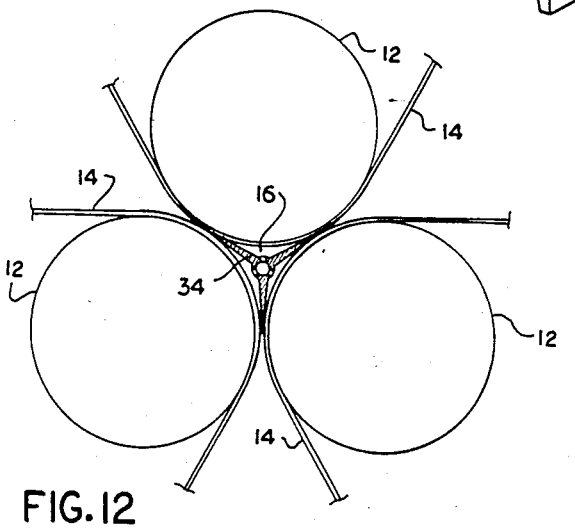

Another arrangement, shown in FIG. 12, employs an internal element 34 which provides both a distribution manifold and internal seal fins or doctor blades. The latter may be provided only at the ends of the chamber 16 to compensate for absence of the webs 14 near the roll ends.

It should be understood from the above that references to relative biasing of the rolls include situations where a roll is fixed and another roll or rolls are biased toward it. References to rotating the roll, or, more fully, to rotating the roll to move the web in a specified direction, are intended to include arrangements where the roll is turned by pull on the web as well as those where the roll is turned by other means such as a drive that is independent of the web.

The rolls referred to herein may be smooth or gravure, and may comprise materials commonly used for rolls such as steel or elastomer. Smooth rolls are presently preferred for highly reactive type coatings.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of coating a passing web with a coating composition, comprising the steps of:

providing an array of at least three parallel rolls;

entraining the passing web partially around a first of the rolls;

constraining the array of rolls so that each respective roll, or any web means entrained thereon, is held against the two adjacent rolls or any web means entrained thereon, to form an elongated chamber surrounded by said array of rolls;

feeding a coating composition to said chamber;

rotating said first roll to move said passing web into said chamber between said first roll and a second roll which is one of the two rolls adjacent the first roll, and to move said passing web out of said chamber between said first roll and a third roll which is also one of the two rolls adjacent the first roll; and rotating said third roll to move the surface thereof, and any web means entrained thereon, in a countermoving direction relative to said passing web as it exits said chamber, whereby the passing web is bathed in the coating composition while in the chamber and encounters a countermoving roll or web surface as it exits the chamber.

2. A method as in claim 1, including the step of maintaining closure of the ends of said chamber during said feeding step.

3. A method as in claim 2, including the step of maintaining a filler object in said chamber to take up a substantial portion of the volume thereof and thereby increase the throughput velocity of said coating composition.

4. A method as in claim 1, including the step of yieldably biasing relatively towards each other at least that pair of adjacent rolls comprising said first roll and said third roll.

5. A method as is in claim 1, including the step of driving all the rolls in the same rotative direction.

6. A method as in claim 1, including the step of similarly coating one or more additional passing webs, each entrained around its own one of said rolls, simultaneously with the coating of said first-named passing web.

7. A method as in claim 1 and further including the steps of:

yieldably biasing relatively towards each other at least that pair of adjacent rolls comprising said first roll and said third roll; and maintaining closure of the ends of said chamber during said feeding step.

8. A method as in claim 7, including the step of driving all the rolls in the same rotative direction.

9. A method as in claim 8, including the step of similarly coating, simultaneously with the coating of said first-named passing web, one or more additional passing webs each entrained around its own one of said rolls and each subjected to a yieldable relative bias between its said own roll and the roll that is adjacent thereto at the point of exit.

10. Apparatus for coating a passing web with a coating composition comprising an array of at least three parallel rolls, said passing web being entrained partially around a first of the rolls, means constraining the array of rolls so that each respective roll, or any web means entrained thereon, is held against the two adjacent rolls, or any web means entrained thereon, to form an elongated chamber surrounded by said array of rolls, means for feeding a coating composition to said chamber, means for rotating said first roll to move said passing web into said chamber between said first roll and a second roll which is one of the two rolls adjacent the first roll, and to move said passing web out of said chamber between said first roll and a third roll which is also one of the two rolls adjacent the first roll, and means for rotating said third roll to move the surface thereof, and any web means entrained thereon, in a countermoving direction relative to said passing web as it exits said chamber, whereby the passing web is bathed in the coating composition while in the chamber and encounters a countermoving roll or web surface as it exits the chamber.

11. Apparatus as in claim 10, including means closing the ends of said chamber.

12. Apparatus as in claim 11, including a filler object within said chamber and taking up a substantial portion of the volume thereof.

13. Apparatus as in claim 10, including means for yieldably biasing relatively toward each other at least that pair of adjacent rolls comprising said first roll and said third roll.

14. Apparatus as in claim 10, including means for driving all the rolls in the same rotative direction.

15. Apparatus as in claim 10, including one or more additional passing webs each entrained around its own one of said rolls of said array.

16. Apparatus as in claim 10 and further including means for yieldably biasing relatively toward each other at least that pair of adjacent rolls comprising said first roll and said third roll, and means closing the ends of said chamber.

17. Apparatus as in claim 16, including means for driving all the rolls in the same rotative direction.

18. Apparatus as in claim 17 including one or more additional passing webs each entrained around its own one of said rolls of said array, and means for subjecting each said additional passing web to a yieldable relative bias between its said own roll and the roll that is adjacent thereto at the point of exit.

* * * * *